US008999027B1

(12) United States Patent
Baxter

(10) Patent No.: US 8,999,027 B1
(45) Date of Patent: Apr. 7, 2015

(54) SELF-CONTAINED SYSTEM FOR SCAVENGING CONTAMINATED AIR FROM ABOVE THE WATER SURFACE OF AN INDOOR SWIMMING POOL

(71) Applicant: Randy Carroll Baxter, Taylors, SC (US)

(72) Inventor: Randy Carroll Baxter, Taylors, SC (US)

( * ) Notice: Subject to any disclaimer, the term of this patent is extended or adjusted under 35 U.S.C. 154(b) by 60 days.

(21) Appl. No.: 13/892,029

(22) Filed: May 10, 2013

Related U.S. Application Data

(60) Provisional application No. 61/802,702, filed on Mar. 17, 2013.

(51) Int. Cl.

| | |
|---|---|
| ***F24F 7/00*** | (2006.01) |
| ***F24F 7/08*** | (2006.01) |
| ***F24F 13/28*** | (2006.01) |
| ***E04H 4/14*** | (2006.01) |
| ***E04H 4/06*** | (2006.01) |

(52) U.S. Cl.
CPC . *F24F 7/08* (2013.01); *F24F 13/28* (2013.01); *E04H 4/14* (2013.01); *E04H 4/06* (2013.01)

(58) Field of Classification Search
CPC ..... F24F 7/00; F24F 7/04; F24F 7/06; F24F 7/065; F24F 7/08; F24F 7/10; F24F 13/0227; F24F 13/0254; F24F 13/0272; F24F 13/02; F24F 13/0209; E04F 17/04
USPC ..... 55/385.2, 385.1, DIG. 18, DIG. 29; 95/273; 454/187, 188, 189, 190, 191, 454/192, 193, 339; 438/905, 909; 4/510
See application file for complete search history.

(56) References Cited

U.S. PATENT DOCUMENTS

| | | | | |
|---|---|---|---|---|
| 3,570,385 | A * | 3/1971 | Heisterkamp et al. | 454/187 |
| 4,054,124 | A * | 10/1977 | Knoos | 126/584 |
| 4,666,487 | A * | 5/1987 | Gerault | 65/530 |
| 4,801,312 | A * | 1/1989 | Mateson | 95/287 |
| 5,203,489 | A * | 4/1993 | Gileta et al. | 228/219 |
| 5,209,402 | A * | 5/1993 | DeBra et al. | 239/1 |
| 5,238,468 | A * | 8/1993 | Gabryszewski et al. | 95/267 |
| 6,517,594 | B2 * | 2/2003 | Olander et al. | 55/385.2 |
| 6,729,795 | B2 | 5/2004 | Dahowski et al. | |
| 6,817,941 | B1 * | 11/2004 | Gatov | 454/187 |
| 7,037,188 | B2 * | 5/2006 | Schmid et al. | 454/187 |
| 7,137,155 | B2 | 11/2006 | Sugrañes Arimany | |
| 7,819,727 | B2 | 10/2010 | Huang et al. | |
| 8,444,747 | B2 * | 5/2013 | Kristensson et al. | 95/14 |

(Continued)

OTHER PUBLICATIONS http://www.youtube.com/watch?v=Mvtsll2tCjo published Mar. 9, 2012.

(Continued)

*Primary Examiner* — Duane Smith
*Assistant Examiner* — Minh-Chau Pham
(74) *Attorney, Agent, or Firm* — Dority & Manning, P.A.

(57) ABSTRACT

Apparatus and methods are disclosed for removing disinfectant by-product contaminants from the air above the water surface of an indoor swimming pool. The apparatus and methods employ a laminar piston-like mass of air that is continuously generated from one side of the pool, sweeps across the water surface of the pool to the opposite of the pool and is sucked away from the opposite side of the pool. The apparatus and methods are applicable to a modified perimeter gutter system and can employ air supply fans, air exhaust fans, specialized laminar air flow diffusers, associated plenums and ducting and contaminant strippers.

21 Claims, 6 Drawing Sheets

(56) References Cited

U.S. PATENT DOCUMENTS

| | | | | |
|---|---|---|---|---|
| 2003/0033790 | A1* | 2/2003 | Hague | 55/385.1 |
| 2003/0121417 | A1* | 7/2003 | Lederer et al. | 95/273 |
| 2004/0192186 | A1* | 9/2004 | Bourgeois et al. | 454/187 |
| 2011/0005178 | A1* | 1/2011 | Lyons et al. | 55/385.7 |
| 2011/0107510 | A1 | 5/2011 | Baker | |
| 2011/0244782 | A1 | 10/2011 | Baker | |

OTHER PUBLICATIONS

Randy C. Baxter, Designing for IAQ in Natatoriums, Apr. 2012, Ashrae Journal.

* cited by examiner

SELF-CONTAINED SYSTEM FOR SCAVENGING CONTAMINATED AIR FROM ABOVE THE WATER SURFACE OF AN INDOOR SWIMMING POOL

CROSS-REFERENCE TO RELATED APPLICATIONS

The present application hereby incorporates herein in its entirety by this reference for all purposes, the entire disclosure of U.S. Provisional Patent Application Ser. No. 61/802,702 filed Mar. 17, 2013.

STATEMENT REGARDING FEDERALLY SPONSORED RESEARCH OR DEVELOPMENT

Not applicable.

FIELD OF THE INVENTION

The subject matter disclosed herein generally involves apparatus and methods of removing contaminants from the air above the water surface of an indoor swimming pool.

BACKGROUND OF THE INVENTION

During the operation of an indoor swimming pool, halogen-based disinfectants such as chlorine or bromine are utilized to react with and remove harmful bacteria and organic materials from the swimming pool water. Compounds referred to as disinfectant by-products (DBPs) are formed as a consequence of the disinfection reactions. Trichloramine, one of the most important of these compounds, off-gasses from swimming pool water and accumulates as a dense gas in the air just above the pool waterline. Trichloramine is an extreme irritant. It causes eye, nose and throat irritation, has been linked to asthma-like symptoms, and causes corrosion on pool building components and equipment. Organic DBPs, such as trihalomethanes, are also present in the air in indoor swimming pools and this class of compounds has been linked to an increased risk for certain types of cancer.

Several devices, systems and methods for removing or controlling the concentration of gaseous contaminants in indoor swimming pools are known in the art. Some devices, systems and methods are directed toward preventing the formation of DBP contaminants in the water by eliminating or minimizing the introduction of nitrogen-containing organic compounds into pool water (nitrogen-containing compounds which react with chlorine or bromine used for disinfecting pool water are responsible for forming these contaminants); these methods have proved to be impractical because swimmers are the primary source of nitrogen-containing compounds. Other systems rely on medium-pressure ultraviolet (UV) light devices to destroy DBP contaminants in the water in the water treatment room before they volatilize and appear in the air; these systems have been demonstrated to be less than totally effective because the creation and volatilization of DBPs can occur before the water can be recycled back to the UV unit. The most common method for controlling off-gassed DBPs relies on the air handling system (HVAC) in the natatorium (swimming pool enclosure) to progressively dilute the concentration of gaseous contaminants through multiple air changes utilizing a large percentage of outside air, until the concentration of contaminants no longer poses a health risk; these methods frequently fail because the energy penalty for heating, cooling and/or dehumidifying large quantities of outside air is too great.

Also known in the art are systems that utilize pool-side exhaust devices (pool-side gutters with integral exhaust features or deck-mounted pool-side exhaust devices) to exhaust contaminated air from the natatorium. These exhaust systems rely on the HVAC system in the natatorium to move contaminated air across the surface of the swimming pool to a position close enough to the gutter to enable the exhaust system to capture and remove, by suction, the contaminated air presented.[10] One such system is described by Baker in U.S. Patent Application No. US20110107510A1 and US20110244782A1. These systems are not capable, on their own, of removing contaminated air from the surface of a pool due to the fact that suction returns cannot independently draw in air and contaminants from a distance of more than a few feet from the face of the return. For example, Huang et al. in U.S. Pat. No. 7,819,727 discloses that the operational distance of push flow is much larger than that of pull (suction) flow and that push-pull systems are more efficient.

These suction systems are even less capable of drawing contaminated air in a direction opposed to the direction of the air circulation caused by the HVAC system; they are, in fact, dependent upon the HVAC system circulation to push contaminated air in the direction of the gutter or pool-side exhaust. These systems are not designed to selectively place airflow in the area where it is needed (the area just above the water surface where the concentration of DBPs is highest), are not designed to localize and control the air supply such as to minimize the amount of air employed to remove contaminated air from the surface of a pool, and are not designed to minimize turbulent mixing of the supplied clean air with the contaminated air. Turbulent mixing of the contaminated air with clean air results in contaminated air being recirculated throughout the natatorium.

Gutter or pool-side exhaust systems that rely on the configuration of the HVAC system to move air in such a way as to present contaminated air to a gutter or pool-side exhaust, are capable of removing gaseous contaminants from the area just above the waterline if an elaborate natatorium HVAC system is carefully designed, maintained and operated. Since gutter exhaust systems rely on complementary functioning of the HVAC system, they are not self-contained. The HVAC system in a natatorium has many functions: to control humidity in the airspace; to control temperature in the airspace; to maintain a negative pressure in the airspace; to provide dry, fresh air to wash over windows, skylights and doors; and to provide dry, fresh air to spectators. Requiring the HVAC system to perform all these normal functions, plus the function of sweeping the pool surface in a carefully controlled manner with minimal expenditure of energy and in the preferred direction to drive contaminated air to the gutter or pool-side return and exhaust, presents a difficult and complex design challenge. It requires the use of large quantities of air and results in an unnecessarily complex and expensive system with high operational costs.

There remains a need in the art for devices and methods that successfully eliminate contaminated air and are efficient, self-contained, easy to build, and easy to integrate into a natatorium system.

BRIEF SUMMARY OF EMBODIMENTS OF THE INVENTION

Apparatus and methods are disclosed for removing disinfectant by-product contaminants that escape into the air above the water surface of an indoor swimming pool. The apparatus and methods provide a self-contained system that operates essentially independently of the HVAC system that services the building surrounding the indoor swimming pool. The apparatus and methods displace and remove contaminated air from the volume of air that sits immediately above the waterline of indoor swimming pools. The apparatus and methods employ a laminar piston-like mass of air that is continuously generated from one side of the pool, sweeps across the water surface of the pool to the opposite side of the pool and is sucked away from the opposite side of the pool. The apparatus and methods are equally applicable to a modified perimeter gutter system and to a gutter-less pool system and can employ air supply fans, air exhaust fans, specialized laminar air flow diffusers, associated plenums and ducting and contaminant strippers.

In accordance with one embodiment, a self-contained scavenging system positively displaces and removes contaminated air from the volume just above the waterline of indoor swimming pools, and exhausts the contaminated air outside the natatorium, or strips the contaminants from the exhaust air stream and returns clean air to the natatorium. The system includes a means to supply controlled-velocity laminar flow scavenging air on one side of an indoor swimming pool and a means to extract scavenging air and contamination on the other side of the pool, using substantially less airflow than existing systems. This embodiment uses laminar flow ventilation, also called piston ventilation, in which the air moves with essentially equal velocity (piston-like bulk flow of a mass of air) as measured across the dimension longitudinally and vertically perpendicular to the direction of the flow. Laminar flow ventilation minimizes mixing of contaminated air with environmental air that is controlled by a natatorium HVAC system.

One aspect of the disclosure, shown in FIG. 2, is comprised of a recessed or semi-recessed gutter with integral air supply disposed along the first wall of the pool and a recessed or semi-recessed gutter with integral exhaust disposed along the opposing second side of the pool. The gutter with integral air supply is comprised of a laminar flow diffuser built into the back wall of the gutter disposed along the first side of the pool near the waterline; and a pressure plenum, the front wall of which is formed by the back wall of the gutter containing the laminar flow diffuser, connected through suitable ductwork to the pressure side of an intake fan having an air intake located within the conditioned airspace of the natatorium. The gutter with integral exhaust is comprised of an integral laminar flow collection diffuser built into the back wall of the gutter disposed along the second side of the pool near the waterline; and a collection plenum, the front wall of which is formed by the back wall of the opposing pool gutter containing the integral laminar flow collection diffuser, connected through suitable ductwork to the suction side of an exhaust fan, the pressure side of which is connected to an exterior exhaust, or to a contaminant stripper such as a charcoal filter or a contaminant-destruction device, and an interior exhaust.

An alternative embodiment of the disclosure is comprised of a pool-side supply disposed separate from the gutter along the first side of the pool and a pool-side exhaust disposed separate from the gutter on the opposing second side of the pool. The pool-side air supply, shown in FIG. 2*d* is comprised of a pool-side laminar flow diffuser; and a supply plenum which is connected to the pressure side of an intake fan having an air intake located within the conditioned airspace of the natatorium. The pool-side exhaust (not shown) is comprised of a laminar flow collection diffuser; and a collection plenum connected to the suction side of an exhaust fan, the pressure side of which is connected to an exterior exhaust, or to a contaminant stripper or other contaminant-destruction device and an interior exhaust.

In another embodiment, the intake fan pulls clean, conditioned air from the natatorium space and distributes this clean air to the pressure plenum disposed near the waterline on the first side of the pool. Air from the pressure plenum is uniformly presented to the laminar flow diffuser that generates, by virtue of its shape and dimensions, a piston-like laminar flow of air. The centerline of the piston-like laminar flow is parallel to the waterline, and extends vertically from near the waterline to the top of the laminar flow diffuser and longitudinally along the entire length of the first side of the pool. The laminar piston-like flow, which is approximately rectangular in cross-section and which moves in bulk at a uniform rate, is directed perpendicularly from the first side of the pool, across the water surface, and toward the opposing second side of the pool, setting up a uniformly-moving blanket of air that remains attached to the surface of the water. This moving blanket of air, which is only of necessary and sufficient size and velocity to effectively scavenge the gaseous contaminants located just above the water surface, carries with it the gaseous contaminants and presents these contaminants to the laminar flow collection diffuser located near the waterline on the opposing second side of the pool. The moving blanket of air, generated by a multiplicity of air jets from the laminar flow diffuser, is independent of air movements generated by the natatorium HVAC system and is configured such that laminar flow is achieved and mixing with room air is minimized. As the contaminated air nears the opposing second side of the pool and the laminar flow collection diffuser near the waterline on the opposing second side of the pool, the negative pressure set up in the collection plenum by the exhaust fan pulls the contaminated air through the laminar flow collection diffuser into the collection plenum which is connected by suitable ductwork to the exhaust fan and subsequently to an exterior exhaust stack where the contaminated air is expelled from the natatorium or the contaminated air is stripped of contaminants and the air so stripped is recycled into the indoor airspace of the natatorium that houses the indoor swimming pool.

In still another embodiment, the intake fan pulls clean, conditioned air from the natatorium space and distributes this clean air to the pressure plenum disposed near the waterline on the first side of the pool. Air from the pressure plenum is uniformly presented to the laminar flow diffuser that generates, by virtue of its shape and dimensions, a piston-like laminar flow of air. The centerline of the piston-like laminar flow is parallel to the waterline, and extends vertically from near the waterline to the top of the laminar flow diffuser and longitudinally along the entire length of the first side of the pool. The laminar piston-like flow, which is approximately rectangular in cross-section and which moves in bulk at a uniform rate, is directed perpendicularly from the first side of the pool, across the water surface, and toward the opposing second side of the pool, setting up a uniformly-moving blanket of air that remains attached to the surface of the water. This moving blanket of air, which is only of necessary and sufficient size and velocity to effectively scavenge the gaseous contaminants located just above the water surface, carries with it the gaseous contaminants and presents these contaminants to the laminar flow collection diffuser located near the waterline on the opposing second side of the pool. The moving blanket of air, generated by a multiplicity of air jets from the laminar flow diffuser, is independent of air movements generated by the natatorium HVAC system and is configured such that laminar flow is achieved and mixing with room air is minimized. As the contaminated air nears the opposing second side of the pool and the laminar flow collection diffuser near the waterline on the opposing second side of the pool, the negative pressure set up in the collection plenum by the exhaust fan pulls the contaminated air through the laminar flow collection diffuser into the collection plenum which is connected by suitable ductwork to the exhaust fan and subsequently to a contaminant-stripper or contaminant destruction device, after which the contaminant-free air is returned to the natatorium.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

Aspects and advantages of the invention are set forth below in the following description, or may be obvious from the description, or may be learned through practice of embodiments of the invention. Those of ordinary skill in the art will better appreciate the features and aspects of such embodiments, and others, upon review of the specification. A full and enabling disclosure of the present invention, including the best mode thereof to one skilled in the art, is set forth more particularly in this specification, including reference to the accompanying figures, in which.

Figure 1:
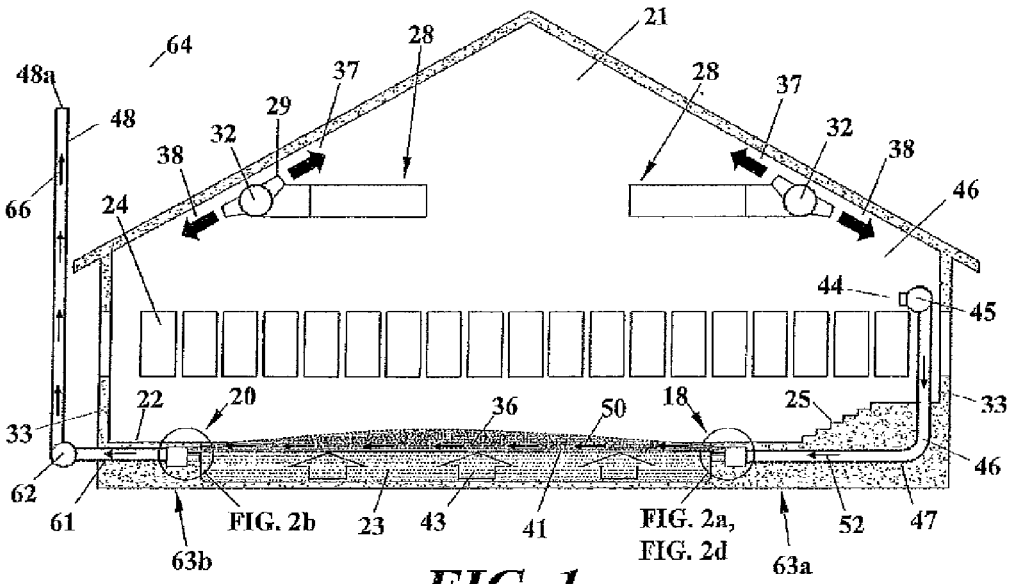
FIG. 1 is a cross-sectional view of a natatorium and pool showing the self-contained off-gas scavenging system.

The accompanying drawings, which are incorporated in and constitute a part of this specification, illustrate at least one presently preferred embodiment of the invention as well as some alternative embodiments. These drawings, together with the written description, serve to explain the principles of the invention but by no means are intended to be exhaustive of all of the possible manifestations of the invention.

DETAILED DESCRIPTION OF THE INVENTION

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the structures.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

References to the vertical refer to the direction that is parallel to the direction of the earth's gravitational pull. References to the axial or longitudinal refer to the lengthwise direction in which the swimming pool has its longest dimension extending along a horizontal direction above the ground and perpendicular to the vertical. References to the transverse or lateral direction refer to the widthwise direction that is perpendicular to the lengthwise direction and to the vertical direction. A reference to the diameter of a surface refers to the diameter of the circle that defines the intersection of the surface with a plane that is normal to the axis of rotation of the surface. References to the circumferential refer to the tangential direction. The meaning of additional reference terms will become apparent through their usages in the text that follows.

FIG. 1 schematically shows a layout of a self-contained scavenging system in an indoor swimming pool according to an exemplary embodiment of the present disclosure. The self-contained scavenging system is comprised of two parts, represented generally by the numerals 63*a* and 63*b*. The typical indoor swimming pool includes a swimming pool 23, a seating area 25, a natatorium 21 that encloses the pool 23 and the seating area 25 indoors in controlled environmental air that has its temperature and humidity controlled by a natatorium HVAC system 28. The contaminated air resides at least initially in the foot or so depth of air that exists directly above the water surface 41 of the pool 23. The present invention is designed to prevent the contaminated air from infiltrating into and mixing with the environmental air that is everywhere inside the natatorium except that initial foot or so depth of air that exists directly above the water surface 41 of the pool 23.

Figure 2:
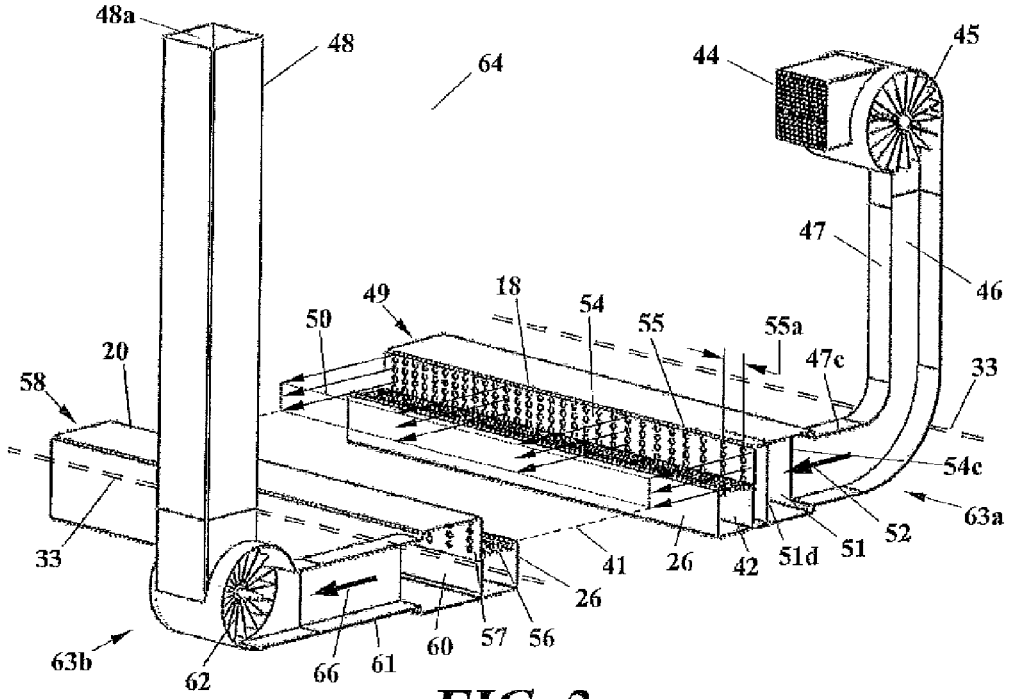
FIG. 2 is an isometric cross-sectional view taken at the midpoint of the length of the self-contained scavenging system only, with the natatorium and pool not shown.

In general and as shown in FIGS. 1 and 2, the self-contained scavenging system can be regarded as having two physically separate and functionally complementary sections, a supply section (indicated generally in FIG. 1 by the numeral 63*a*) and an exhaust section (indicated generally in FIG. 1 by the numeral 63*b*). FIG. 2 shows one embodiment of the self-contained scavenging system, including the supply section 63*a* and the exhaust section 63*b*.

Description of the Supply Section

Figure 2A:
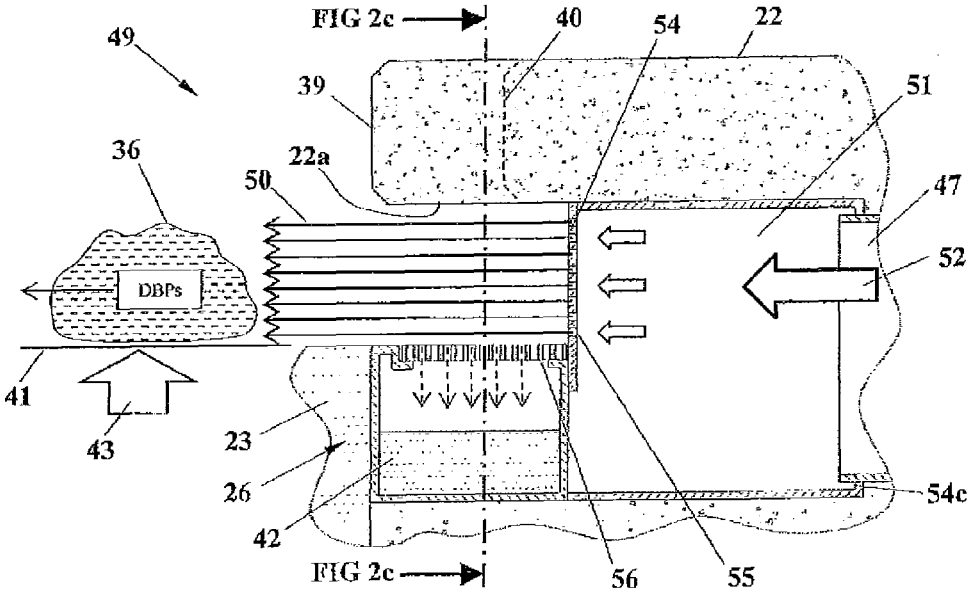
FIG. 2*a* is a schematic representation of an enlarged cross-sectional view of the circled portion labeled FIG. 2*a* in FIG. 1, showing the laminar flow off-gas scavenging system supply gutter.

The supply section 63*a* is generally disposed along a first elongated side 18 of an indoor swimming pool and provides for intake of fresh air and a means to supply scavenging air in the area just above the surface of the water that fills the pool. In the exemplary embodiment schematically shown in FIG. 2, the supply portion of the supply section 63*a* desirably includes a supply gutter 49 and associated components as detailed below. Referring to FIG. 2, the intake portion of the supply section 63*a* desirably includes a fresh air intake 44 located inside a wall 33 of the natatorium that encloses the indoor swimming pool. The fresh air intake 44 desirably is disposed indoors within the conditioned airspace of the natatorium along with an air intake fan 45 and a fresh air supply duct 47. The suction side of the air intake fan 45 is connected to fresh air intake 44 and the pressure side of the air intake fan 45 is connected to one end of the fresh air supply duct 47, which receives the air flow output of the air intake fan 45. As shown in FIG. 2*a* for example, the opposite end of the fresh air supply duct 47 desirably is connected to supply the positive pressure air flow output of the air intake fan 45 to a pressure plenum 51.

As shown generally in FIG. 2 and in detail in FIG. 2*a*, the supply gutter 49, which forms the supply portion of the supply section 63*a*, can include a conventional perimeter gutter 26, behind (behind or back is defined as located in a position away from the pool water) which, in the subject disclosure, has been added a conduit, pressure plenum 51, extending the entire length of the first elongated side 18 of the pool. The pressure plenum 51 and the perimeter gutter 26 and ducting can be constructed of stainless steel, PVC or any other material that will withstand the corrosive conditions of a typical indoor swimming pool. A baffle 51*d* can be disposed within the pressure plenum 51 and function to create more uniform air flow within the pressure plenum 51.

As shown in FIG. 2*a* for example, a back wall 54*c* of the pressure plenum 51 is penetrated, in at least one instance, by the fresh air supply duct 47. The penetration of the pressure plenum 51 by the supply duct 47 is preferentially located near the center of the length of the pressure plenum 51, but said penetration can also be located at any point along the length of the pressure plenum 51. The front (water side disposed closer to the water filling the pool 23) wall of the pressure plenum 51 is formed by a laminar flow diffuser 54 that also forms the back wall of the perimeter gutter 26. The pressure plenum 51 is comprised of a front wall formed by the laminar flow diffuser 54, the back wall 54*c* containing the supply duct 47 penetration, a top wall, a bottom wall and two ends which complete the pressure plenum 51. Also shown is a representation of pool water level 41 which is determined by the vertical position of the lip of the perimeter gutter 26; and a representation of overflow water 42 that flows through a grating 56 before returning to the pool filter/pump recirculation system.

Figure 2B:
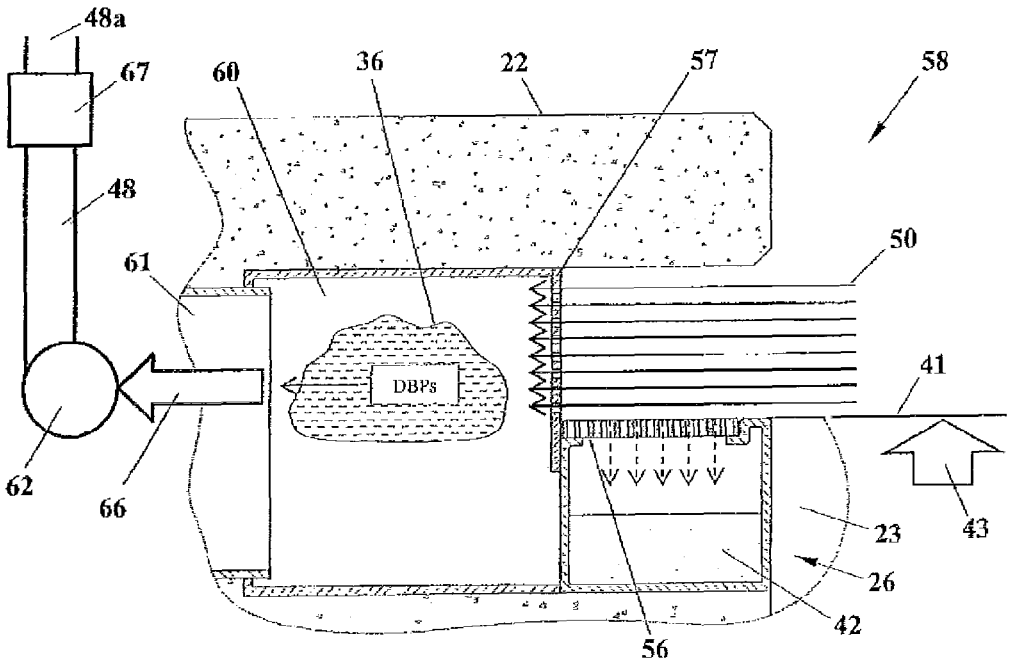
FIG. 2*b* is a schematic representation of an enlarged cross-sectional view of the circled area labeled FIG. 2*b* in FIG. 1, showing the laminar flow off-gas scavenging system exhaust gutter.
Figure 2C:
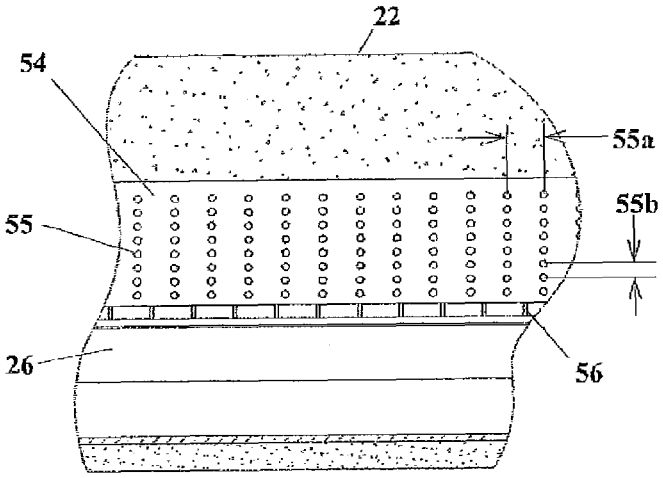
FIG. 2*c* is a cross-sectional view taken in the direction in which the arrows FIG. 2*c*-FIG. 2*c* point in FIG. 2*a*, showing a view of the laminar flow diffuser.
Figure 2D:
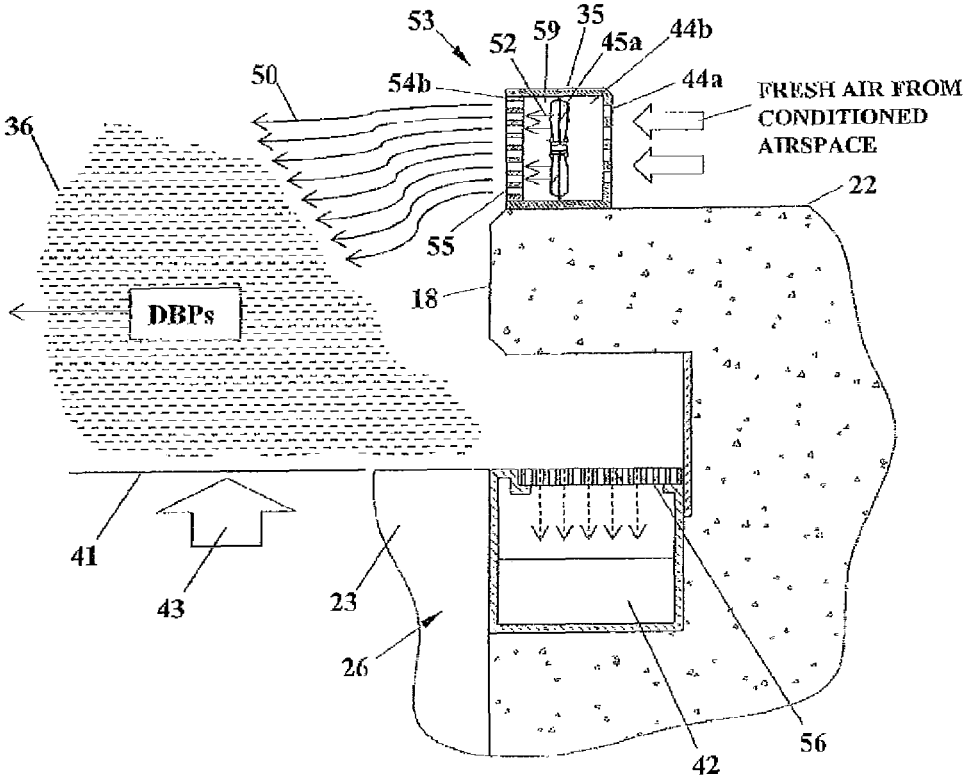
FIG. 2*d* is a schematic representation of an enlarged cross-sectional view of the circled area labeled FIG. 2*d* in FIG. 1, showing the laminar flow off-gas scavenging system pool-side supply.

In another embodiment, a pool-side supply section is schematically shown in FIG. 2*d*. The pool-side supply section 53 desirably includes a housing 35 disposed along the first elongated side 18 of a swimming pool, a pool-side laminar flow diffuser 54*b* forming the front (water side) wall of the housing 35, a pool-side fresh air intake 44*a* forming the opposing back wall of the housing 35, and at least one pool-side air intake fan 45*a* located inside the housing 35. The volume enclosed by the housing 35 is comprised of an intake plenum 44*b* and a pool-side pressure plenum 59, separated by the pool-side air intake fan 45*a*. Though not visible in the view shown in FIG. 2*d*, in one alternative embodiment a plurality of air intake fans 45*a* can be disposed within the housing 35. Moreover, in such an alternative embodiment, each air intake fan 45*a* in the plurality desirably is spaced apart along the length of the housing 35 from each other air intake fan 45*a* in the plurality, and each air intake fan 45*a* desirably is disposed between the laminar flow diffuser 54*b* and the fresh air intake 44*a*. It is believed that a twelve volt electric fan generating 50 CFM of air flow will suffice for each of the air intake fans 45*a*.

Description of the Exhaust Section

As schematically shown in FIG. 2 for example, the exhaust section 63*b* is generally disposed along a second elongated side 20 of an indoor swimming pool 23 and receives the scavenging air flow that originates from the supply section 63*a* disposed along the first elongated side 18 of the pool.

As schematically shown in FIGS. 2 and 2*b* for example, an embodiment of the return portion of the exhaust section 63*b* desirably includes an exhaust gutter 58. The exhaust gutter 58 desirably includes a laminar flow collection diffuser 57 that has open areas to varying degrees along the length of the diffuser 57 and that receive the air that moves just above the surface of the water that fills the pool. The exhaust gutter 58 also desirably includes a collection plenum 60. In this exemplary embodiment, the laminar flow collection diffuser 57 and the collection plenum 60 are disposed behind the conventional perimeter gutter 26 of the swimming pool and extend the entire length of the second elongated side 20 of the pool. The collection plenum 60, the perimeter gutter 26 and their associated ducting desirably can be constructed of stainless steel, PVC or any other material that will withstand the corrosive conditions of a typical indoor swimming pool.

The collection plenum 60 is defined in part by opposite end walls, a top wall, a back wall and a bottom wall. In this exemplary embodiment, the back wall of the collection plenum 60 is penetrated, in at least one instance, by an exhaust duct 61. The penetration of the collection plenum 60 by the exhaust duct 61 is desirably located near the center of the length of the collection plenum 60, but the location of this penetration also can be located at any point along the length of the collection plenum 60.

Of particular import to this embodiment of the present invention is the fact that the collection plenum 60 is formed in part by a front wall that faces the water surface of the pool, is air-permeable and formed by the laminar flow collection diffuser 57. The front wall of the collection plenum 60 also forms the back wall of the perimeter gutter 26.

Still referring to FIGS. 2 and 2*b*, the exhaust portion of the exhaust section 63*b* desirably includes one end of the exhaust duct 61 connected to the collection plenum 60 and the opposite end of the exhaust duct 61 connected to the suction side of an air exhaust fan 62. Additionally, an external discharge duct 48 desirably has one end connected to the pressure side of the air exhaust fan 62 and receives the output air flow from the air exhaust fan 62. An opposite end of the external discharge duct 48 desirably is connected to a discharge port 48*a*, which in one embodiment of the system is desirably disposed outdoors (e.g., FIG. 1) but can be disposed indoors in another embodiment of the system (e.g., FIG. 2*b*).

In the embodiment schematically shown in FIG. 2 for example, the external discharge duct 48 desirably can be located external to the wall 33 and thus outdoors from the natatorium. In such an embodiment, the external discharge duct 48 discharges DBP-contaminated air to the outside air that is schematically designated by the numeral 64 in FIG. 2. However, as schematically shown in FIG. 2*b* for example, in an alternative embodiment, an opposite end of the external discharge duct 48 discharges DBP-contaminated air to a contaminant stripper 67 such as a charcoal filter, which captures the contaminants, or a contaminant-destruction device, which chemically transforms the contaminants into less harmful molecules.

The disposition of the supply section 63*a* and the exhaust section 63*b* along the elongated sides of a swimming pool is advantageous because the time required for the air from the supply section 63*a* to reach the exhaust section 63*b* on the opposite elongated side of the pool is minimized due to the fact that the flow traverses the shortest dimension of a rectangular pool. The benefit is that the time required to scavenge the contaminated air from the surface of the pool is also minimized for a given velocity of the laminar piston-like flow. An alternate disposition with both the supply section 63*a* and the exhaust section 63*b* elongating parallel to the short sides of a rectangular pool also is possible, but resulting in either a longer time required or an increase in the air velocity required to scavenge contaminated air from the surface of the water in the pool. Due to the fact that disinfectant by-products can begin to accumulate in a matter of minutes, it is desirable to limit the time required to move the contaminants in the air above the surface of the water in the pool from the first elongated side 18 of the pool to the second elongated side 20 of the pool to approximately 10 minutes or less.

Function of the Supply Section

As shown in FIGS. 2 and 2*a*, the supply gutter 49, located on the first elongated side 18 of the pool, is configured to contain the components establishing a controlled laminar flow of a mass of fresh air in the area just above the surface 41 of the water in the pool and originating from the first elongated side 18 of the pool. In this embodiment shown in detail in FIG. 2*a*, the supply gutter 49 includes the pressure plenum 51 that receives fresh air 46 (FIG. 2) from the air intake fan 45 through the fresh air supply duct 47, distributes the fresh air as supply air 52 throughout the pressure plenum 51 along the entire length of the first elongated side 18 of the pool and presents the supply air 52, under pressure, to the upstream side of the laminar flow diffuser 54.

As schematically shown in FIG. 2*c* for example, the laminar flow diffuser 54 is configured such that a multiplicity of precisely-spaced orifices 55 are distributed along the entire length and height of the laminar flow diffuser 54, which extends longitudinally along the full length of the first side 18 of the pool, and extends vertically from the waterline to the underside 22*a* of a pool deck 22. The gutter system, to which the scavenging system has been added in the illustrated embodiment of the present invention, may be of the recessed type or of the semi-recessed type. A recessed gutter deck line 39 and a semi-recessed gutter deck line 40 are shown in FIG. 2*a* for example.

The open flow through area of each orifice 55 in the laminar flow diffuser 54 is sized, and the orifices 55 are of sufficient number, to present a total flow area that will pass a volumetric air flow rate and produce a given bulk air flow velocity when supplied with a known pressure in pressure plenum 51. The given bulk airflow velocity is a velocity sufficient to cause the bulk air flow to traverse the distance between the first elongated side 18 of the pool 23 and the second elongated side 20 of the pool 23 in a predetermined time. The orifices 55 can be circular holes or rounded slots, or any other geometric configuration, provided the desired volumetric air flow rate is produced, and as long as the air velocity through each orifice 55 is consistent with a throat Reynolds Number less than approximately 1000 thereby giving laminar flow, so as to produce air jets that do not mix with the surrounding environmental air.

A plurality of laminar flow diffuser orifices 55 (shown in detail in FIG. 2*c*) produce a plurality of laminar flow air jets emanating from the downstream-facing side of the laminar flow diffuser 54. These laminar flow air jets quickly coalesce and form a rectangular cross-section, laminar piston-like flow 50 (as schematically shown in FIGS. 2, 2*a*, 2*b* and 2*d*) that produces a uniformly-moving mass of fresh air extending longitudinally along the entire length of the first elongated side 18 of the pool and vertically from the waterline to the top of the laminar flow diffuser 54. The laminar piston-like flow 50 also extends laterally across that entire width of the pool. It is this controlled-velocity laminar flow scavenging air mass that emanates from the laminar flow diffuser 54 disposed on one side of the indoor swimming pool that sweeps across the water surface 41 of the indoor swimming pool 23 to push contaminated air from above the water surface 41 of the swimming pool 23 toward the opposite second pool edge 20 of the indoor swimming pool 23.

The moving cloud of fresh air moves from the first elongated side 18 to the second elongated side 20 of the pool with a velocity determined by the volumetric flow rate through the laminar flow diffuser 54 produced by the air intake fan 45 and the rectangular cross-sectional area of the laminar piston-like flow 50 as schematically shown in FIG. 2. Piston flow is defined as the uniform bulk flow of a liquid or a gas in which all parts of the gas move at the same velocity and in the same direction in much the manner that a solid piston moves.

Due to duct flow losses of pressure from frictional forces as the supply air 52 moves along the length of the pressure plenum 51, the air pressure of the supply air 52 in the pressure plenum 51 can vary as a function of the distance of the supply air 52 from the pressure source, which in the embodiment shown in FIG. 2 is the fresh air supply duct 47. If left uncompensated, these pressure losses in the supply air 52 will produce pressure differences that will result in progressively lower flow velocity through the laminar flow diffuser 54 at progressively greater distances from the fresh air supply duct 47. Lower flow velocities through the laminar flow diffuser 54 at greater distances from fresh air supply duct 47 will result in a non-uniform flow velocity profile longitudinally from one end of the elongated sides of the pool to the other, and an absence of piston-like flow. An absence of piston-like flow increases the likelihood of mixing the contaminated air with non-contaminated air in situations where the piston-like flow supply rate exceeds the removal flow rate through the laminar flow collection diffuser 57 shown in FIG. 2.

However, it is possible to compensate for these pressure losses in the supply air 52. As shown in FIG. 2, the multiplicity of orifices in the laminar flow diffuser 54 can be carefully configured to ensure that all portions of the laminar piston-like flow 50, longitudinally from one end of the elongated sides of the pool to the other, move in unison and with equal velocity even when the orifices 55 in different sections of the laminar flow diffuser 54 are fed by supply air 52 with different pressures along the length of pressure plenum 51.

As schematically shown in FIG. 2*d* in an alternative embodiment that can be used to retrofit a pre-existing indoor pool, the pool-side supply 53, located on the deck 22 on the first elongated side 18 of the pool is configured to contain the components that set up a controlled flow of fresh air in the area just above the water surface of the pool and originating from the first elongated side 18 of the pool. In this alternative embodiment, the pool-side air intake fan 45*a* pulls fresh air from the natatorium through the entire length of pool-side fresh air intake 44*a* into the full length of the intake plenum 44*b* and distributes fresh air under pressure into the full length of pool-side pressure plenum 59, which in turn discharges fresh air through the full length of the laminar flow diffuser 54*b*. The pool-side laminar flow diffuser 54*b* is also configured such that its orifices 55, which are precisely spaced and/or sized as a function of their distances from the pool-side air intake fan 45*a*, are distributed along the entire length and height of the pool-side laminar flow diffuser 54*b*, which extends longitudinally along the full length of the first elongated side 18 of the pool. The orifices 55 in the pool-side laminar flow diffuser 54*b* are sized, and are of sufficient number, to present a total flow area that will pass a volumetric air flow rate and produce a given bulk air flow velocity when supplied with a known pressure from the pool-side air intake fan 45*a*. The given bulk airflow velocity is a velocity sufficient to cause the bulk air flow to traverse the distance between the first elongated side 18 of the pool and the second elongated side 20 of the pool in a predetermined time. The orifices 55 can be circular holes or rounded slots, or any other geometric configuration, provided the desired volumetric air flow rate is produced, and as long as the air velocity through each orifice 55 is consistent with a throat Reynolds Number less than approximately 1000 thereby giving laminar flow, so as to produce air jets that do not mix with the surrounding indoor air within the natatorium. These laminar flow jets quickly coalesce with each other and form a rectangular cross-section, laminar piston-like flow 50 (as shown in FIGS. 2, 2*a*, 2*b* and 2*d*), that produces a uniformly-moving mass of fresh air extending longitudinally along the entire length of the first side 18 of the pool and vertically from the waterline to the top of the pool-side laminar flow diffuser 54*b*. The laminar piston-like flow 50 also extends laterally across that entire width of the pool.

Referring to FIGS. 1, 2*a*, 2*b* and 2*d*, a concentration of disinfectant by-products 43 is continually formed in the pool water as a consequence of the reaction between chlorine or bromine disinfectants and nitrogen-containing compounds in pool water. These compounds are volatile and readily escape the pool water to form a gaseous disinfectant by-product (DBP) cloud 36 of contaminated air. The laminar piston-like flow 50 (also shown in FIG. 2) moves the DBP cloud 36 from the first elongated side 18 of the pool to the second elongated side 20 of the pool. As the DBP cloud 36 is cleared away, fresh air from the supply air 52 or 52*b* (also shown in FIGS. 1 and 2), replaces the contaminated air in the area just above the waterline of the pool. It is important that the laminar flow diffuser 54 or pool-side laminar flow diffuser 54*b* produces a bulk-motion, uniform-velocity laminar flow cloud that minimizes mixing of the DBP cloud 36 with the surrounding room air. It also is important for energy efficiency that the vertical dimension of the laminar piston-like flow 50 is minimized so as to supply only the necessary and sufficient volumetric flow of air to clear the volume occupied by the DBP cloud 36 within the desired 10-minute timeframe.

Function of the Exhaust Section

As schematically shown in FIGS. 2 and 2*b*, the exhaust gutter 58 located on the second elongated side 20 of the pool is configured to contain the components that accept the DBP cloud 36 scavenged from the surface of the water by the laminar piston-like flow 50 generated by supply gutter 49 (also shown in FIG. 2*a*) or pool-side supply 53 shown in FIG. 2*d*. In this embodiment shown schematically in detail in FIG. 2*b*, the exhaust gutter 58 includes the laminar flow collection diffuser 57 containing sufficient open area at all locations to accept the volumetric flow rate presented by the laminar piston-like flow 50 when the laminar flow collection diffuser 57 is subjected to a partial vacuum from the collection plenum 60 generated by the air exhaust fan 62 through the exhaust duct 61. It is important that the areas and spacing of the orifices 55 of the laminar flow collection diffuser 57 and the volumetric flow capacity of the air exhaust fan 62 are properly sized to accept a volumetric flow rate, at all points along the full length of the laminar flow collection diffuser 57, that is equal to or greater than the volumetric flow rate presented by the laminar piston-like flow 50 so that no contaminants are allowed to escape to the indoor air circulation within the natatorium. The DBP cloud 36 is pulled into the collection plenum 60 and through the exhaust duct 61 by the air exhaust fan 62. In one embodiment schematically shown in FIG. 1 for example, the air exhaust fan 62 discharges contaminated exhaust air 66 through the external discharge duct 48 to the outside air 64.

If the average volumetric flow rate through any section of the laminar flow collection diffuser 57 at any longitudinal position, shown in FIG. 2, along the full length of the laminar flow collection diffuser 57 is allowed to fall below the average volumetric flow rate of the laminar piston-like flow 50 at the corresponding longitudinal positions, then not all of the contaminated air will be accepted at that longitudinal position. If this occurs, then a portion of the contaminated air will escape the scavenging action, and contaminated air will migrate into the indoor air circulation within the natatorium. Thus, it is desirable to compensate for known, calculable changes in volumetric flow rate, such as pressure drop along a duct like the collection plenum 60, in order to maintain the optimum average volumetric flow rate through all sections of the laminar flow collection diffuser 57.

Example of System Function

Reference will now be made to a design example showing a typical application of the disclosure. The values given in this example are provided by way of explanation of the disclosure, not limitation of the disclosure. It will be apparent to those skilled in the art that various modifications in the values assigned to the variables in this example can be made without departing from the scope or spirit of the disclosure.

Referring to FIGS. 2 and 2*a*, an example 50-meter long, 75-foot wide swimming pool (a common configuration) may require a rectangular laminar piston-like flow 50 cross-section with a dimension of 50 meters (164 feet) length in the longitudinal direction and, typically, 8 inches high in the vertical dimension, giving an area of 109.3 square feet. Assuming that the laminar flow diffuser 54 has a number of evenly-spaced orifices 55 of uniform size and sufficient area such that the laminar flow diffuser has an open area of 46%, then the volumetric flow rate required to move a cloud from the first side 18 to the second elongated side 20 of the pool in 10 minutes can be calculated, as can the flow rate and Reynolds number through each orifice 55, as shown below:

$V_c$=velocity of the cloud=75 feet/10 minutes=7.50 feet/min.

$Q_p$=supply air flow rate=7.50 feet/min×109.3 sq. ft.=820 cubic ft./min.

$V_{orifice}$=velocity through each orifice=7.5 feet per min/.46=16.3 feet/min.

$R_{e\ throat}$=throat Reynolds number through each orifice=192=laminar flow

If the assumption is made that each orifice 55 in the laminar flow diffuser 54 (or laminar flow collection diffuser 57) is 0.50 inches in diameter and thus has an area=0.196 square inches, then 37,264 orifices 55 would be required in this example and the throat Reynolds number for each orifice is 192. This throat Reynolds number is low enough to produce laminar flow through the orifice 55. When supplied with 820 cubic feet per minute (CFM) of fresh air as calculated above, these orifices 55 will produce 37,264 individual laminar flow air jets, with a flow of 0.022 CFM per orifice 55 or 7.5 CFM per square foot of area of the laminar flow diffuser 54 (or laminar flow collection diffuser 57). These air jets will coalesce with one another and form the laminar piston-like flow 50, sweeping from the first elongated side 18 to the second elongated side 20 of the pool in 10 minutes. It is desirable that the number of orifices 55 and the flow area of each orifice 55 are selected to deliver a total quantity of air satisfying three requirements: the velocity of the laminar piston-like flow 50 must be such that the width of the pool is traversed and cleared within the design timeframe (10 minutes in this example), the bulk velocity of the air flow should remain below the flow that avoids chilling of swimmers (currently 25 feet/min. as per ASHRAE recommendation), and the flow through each orifice 55 should remain laminar. The orifice specific flow can be as high as 0.120 CFM and still remain laminar with a Reynolds number less than 1000.

As noted above, due to friction (pressure) losses associated with air flow through a duct, the actual pressure presented to the laminar flow diffuser orifice 55 in the laminar flow diffuser 54 will vary according to the distance of the particular orifice 55 from the centerline of the entry point of the fresh air supply duct 47 into pressure plenum 51, measured parallel to the first elongated side 18 of the pool. As shown in FIG. 2*c*, to account for these pressure losses and provide equal air flow through each orifice 55 or through the area of each section of the laminar flow diffuser 54, the area of the laminar flow diffuser orifice 55 or a horizontal (column) and vertical (row) spacing of orifices 55 in the laminar flow diffuser 54, and represented by the numerals 55*a* and 55*b* respectively, must be varied as a function of the distance of the particular orifice 55 from fresh air supply duct centerline 47*c* (shown in FIG. 3) in order to create the desired uniform-velocity, laminar piston-like flow 50 when measured at any point longitudinally and perpendicularly to the direction of flow of the laminar piston-like flow 50. Changing the spacing of equal-sized orifices 55 in a section of the laminar flow diffuser 54 will cause a change in the percentage of open area (total area open to flow÷ total laminar flow diffuser area×100) in that particular section of the laminar flow diffuser 54. Changing the percentage of open area for a section of the laminar flow diffuser 54 will result in a change in flow per unit area for that section.

Figure 3:
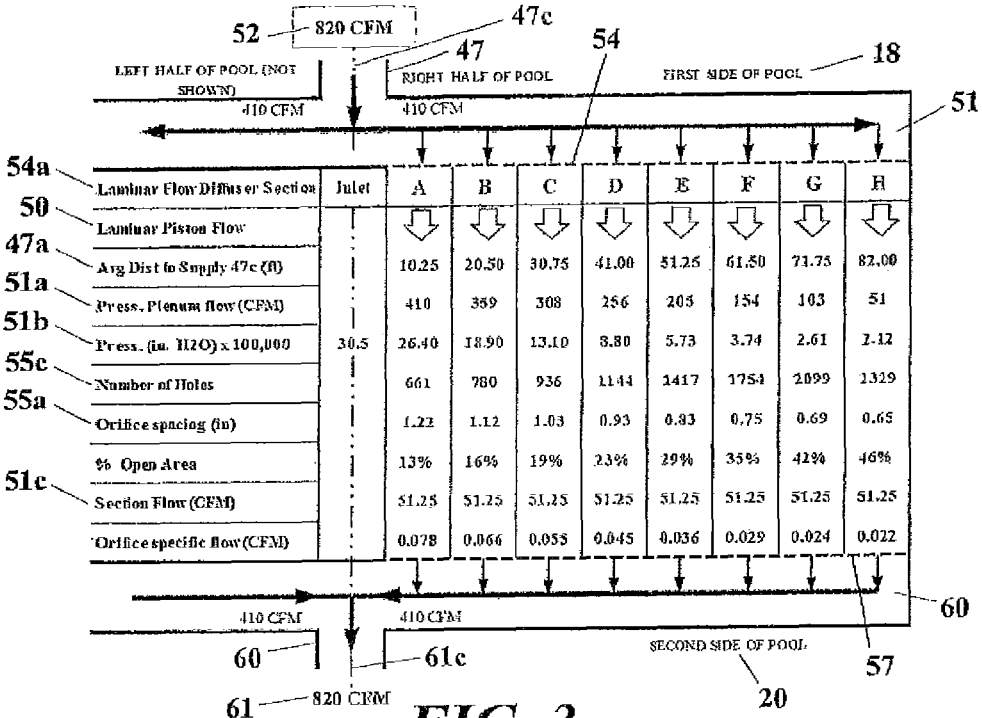
FIG. 3 is a schematic representation of a plan view of one half of a typical pool showing the calculated flows, pressures, and orifice configurations for the laminar piston flow which traverses from the first side of the pool to the second elongated side of the pool.

Although it is theoretically possible to continuously adjust the spacing of each column of orifices 55 as a function of distance from the fresh air supply duct centerline 47*c* as schematically shown in FIG. 3, or to adjust the area of each orifice 55 in the same way to achieve the average flow of 7.5 CFM per square foot, it is sufficient for this application, and more economical, to divide the length of the laminar flow diffuser 54 into convenient section lengths (16 lengths of 10.25 feet each in this example) and adjust the spacing of all the orifices 55 (keeping the orifices 55 uniform in size, shape and area) in each particular section, based on the average distance of the particular section from the fresh air supply duct centerline 47*c*, to give the correct average flow of 7.5 CFM per square foot for the section. In this manner, a reduction of percentage open area in a section of the laminar flow diffuser 54 where the pressure is high can be used to reduce the average flow to 7.5 CFM per square foot, and an increase of percentage open area in a section of the laminar flow diffuser 54 where the pressure is low can be used to increase the average flow to 7.5 CFM per square foot.

Other methods of achieving the average flow of 7.5 CFM per square foot over a long section of laminar flow diffuser 54 are possible. Such methods include employing an extremely large cross-section pressure plenum 51, or by employing many fresh air supply ducts 47 spaced along the length of pressure plenum 51, or by employing much higher pressure drops across each orifice 55 of the laminar flow diffuser 54 compared to the pressure drop along the length of pressure plenum 51. However, due to high construction costs or high operating costs, none of these methods is practicable.

FIG. 3 is a tabular and schematic representation of one-half of the typical swimming pool described in the design example above, showing calculated values. For simplicity, only the right side of the example pool is shown. The system configuration and table values for the left side of the pool are mirror images of the right side shown. FIG. 3 shows the flow rate of the supply air 52, the spatially-distributed pressure in pressure plenum 51, the adjusted orifice spacing 55*a* in the laminar flow diffuser 54, and an adjusted average section flow 51*c* as calculated for the design example described above.

The required input flow of 820 CFM calculated in the design example is indicated in FIG. 3 by the numeral 52. In the design example, the supply air 52 is introduced in the middle of the first side of the swimming pool at fresh air supply duct centerline 47*c*, so that half of the supply air 52 is directed to the left side of the pool leaving 410 CFM of air to supply the pressure plenum 51 on the right side of the pool.

Because of friction losses along the 82-ft length of pressure plenum 51, shown in FIG. 2 and schematically in FIG. 3, the static pressure in pressure plenum 51 will decrease as the distance from fresh air supply duct centerline 47*c* increases. To simplify calculation of these pressure losses and the pressure distribution along the length of the pressure plenum 51, each of the length of the pressure plenum 51 and the length of the laminar flow diffuser 54 has been subdivided into sections, and each of the sections is 10.25 feet long. These sections are shown in FIG. 3 on the row labeled: 54*a*—laminar flow diffuser section, Each section is represented by a letter A through H. The respective average distances of each section from the fresh air supply duct centerline 47*c* are tabulated in FIG. 3 for each section on the row labeled: 47*a*—average distance to supply 47*c*.

The row labeled: 51*a*—pressure plenum flow, shows the average flow in CFM for each pressure plenum 51 section. Each section of laminar flow diffuser 54 is designed to take an equal share of the 410 CFM flow (51.25 CFM) until the longitudinal flow in pressure plenum 51 at the end of section H is zero. With the assumption that each section of the laminar flow diffuser 54 removes 51.25 CFM from the pressure plenum 51 flow, the pressure drop for a 1 square-foot pressure plenum 51 duct can be calculated for each section using the Darcy and Colebrook equations as specified in the *ASHRAE Fundamentals Handbook, Chapter* 21—*Duct Design, Friction Losses:*

Darcy Equation $$\Delta p_f = 12fL\frac{12fL}{Dh}\rho\left(\frac{V}{1097}\right)^2$$

Where:

$\Delta p_f$=friction loss (pressure) in inches of water f=friction factor, dimensionless L=duct length in feet $D_h$=hydraulic diameter of duct in inches=4×duct area×duct perimeter V=velocity of air in duct in feet per minute ρ=density of air in Ibm/ft$^3$ The dimensionless friction factor, f, can be calculated from the following Colebrook equation which must be solved iteratively:

$$\frac{1}{\sqrt{f}} = -2\log\left(\frac{\varepsilon}{3.7Dh} + \frac{2.51}{\mathrm{Re}\sqrt{f}}\right)$$

Where ϵ=material absolute roughness factor in feet, and Re=Reynolds number, which is dimensionless.

Assuming a beginning pressure of 30.5E-6 inches $H_2O$ at the fresh air supply duct centerline 47*c*, the average pressure presented to each laminar flow diffuser 54 section can be calculated by subtracting the cumulative loss of pressure at each section. In FIG. 3, the row labeled 51*b*—pressure (in H2O)×100,000, shows the calculated average pressure at each laminar flow diffuser 54 section. Using the average pressure and the area of each orifice 55, the average flow for each laminar flow diffuser 54 section can be calculated. As can be seen in FIG. 3 in the row labeled 51*b*, the pressure presented to the first laminar flow diffuser 54 section (A) is the largest, and the pressure presented to the last laminar flow diffuser 54 section (H) is the smallest. The flow for the laminar flow diffuser orifice 55 in a section is calculated from the orifice flow equation, which is derived from Bernoulli's equation:

$$\dot{m}=CA\sqrt{2\rho\Delta P}$$

Where:

ṁ=flow in kg/sec

C=flow coefficient=$Cd/(1-\beta^4)^{.5}$

β=orifice diameter/pipe diameter

A=orifice area in $m^2$

ρ=air density in $kg/m^3$

ΔP=pressure across orifice in Pascal ($kg/m-s^2$)

The average flow for each laminar flow diffuser 54 section can then be adjusted to account for the pressure difference in each section by adjusting the number of equally-spaced orifices 55 in each laminar flow diffuser 54 section, or by other means resulting in a difference in the per cent open flow area for the section.

In FIG. 3, the row labeled 55*c*—number of holes (orifices 55), shows the required number of holes (orifices 55) in each section of the laminar flow diffuser 54 to provide the desired 51.25 CFM average flow in that section as shown in the row labeled 51*c*. When the air velocities produced by all sections of the laminar flow diffuser 54 along the first side 18 of the pool are equal, then the desired uniform velocity laminar piston-like flow 50 will be generated and will move in bulk fashion from the first side 18 of the pool to the second elongated side 20 of the pool.

The laminar flow collection diffuser 57 sections, shown in schematically in FIG. 3 and in FIG. 2, in exhaust section 63*b* are sized in a similar manner to those in the supply section 63*a* except that the sections are sized as a function of their distance from the exhaust duct centerline 61*c*, so that the volumetric flow rate of any section is greater than or equal to the volumetric flow rate of the piston-like flow 50 in that section.

Description of HVAC Airflow in a Natatorium

Figure 4:
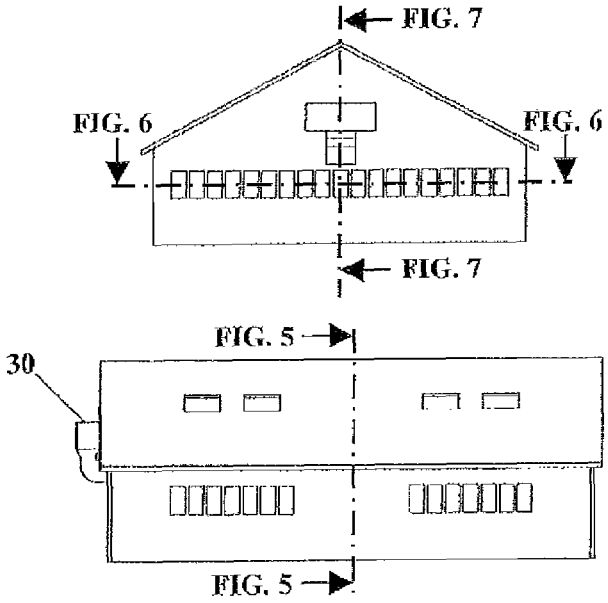
FIG. 4 is an elevation drawing of a typical natatorium with section planes FIG. 5-5, FIG. 6-6 and FIG. 7-7 identified for use in subsequent drawings.
Figure 5:
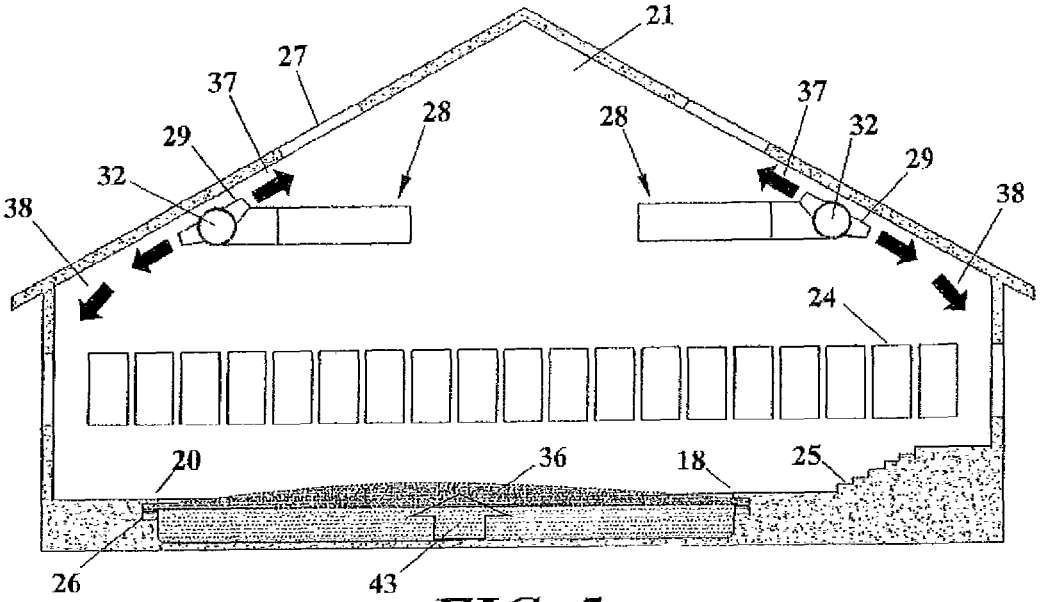
FIG. 5 is a cross-sectional view of FIG. 4 taken in the direction which the arrows FIG. 5-5 point, showing typical air flow patterns produced by a natatorium HVAC system and the location of the out-gassed disinfectant by-product cloud in a typical natatorium.
Figure 6:
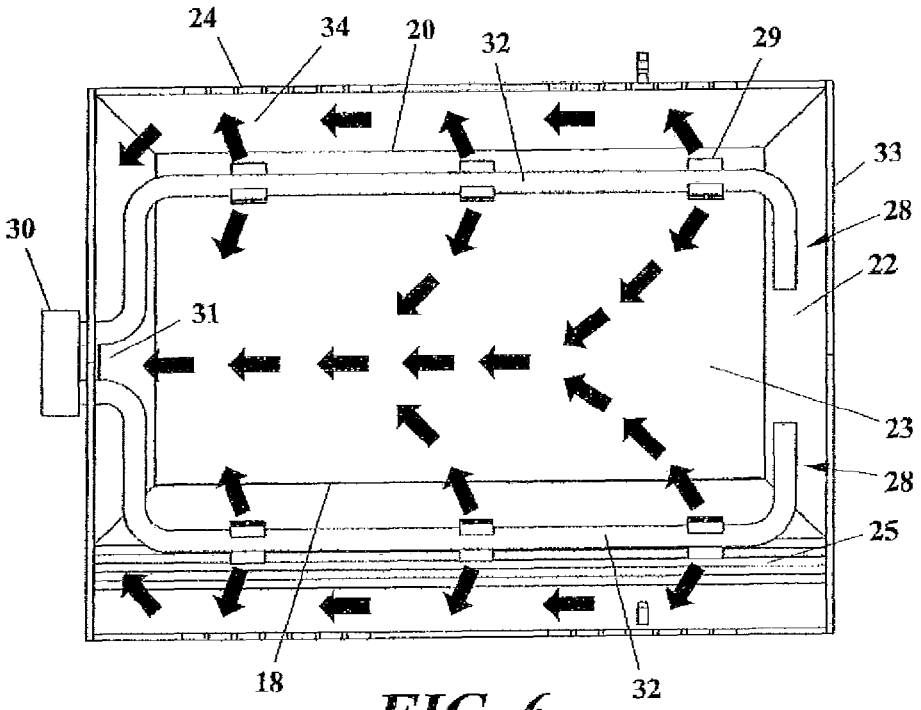
FIG. 6 is a cross-sectional view of FIG. 4, taken in the direction in which the arrows FIG. 6-6 point, showing air flow patterns produced by a natatorium HVAC system.
Figure 7:
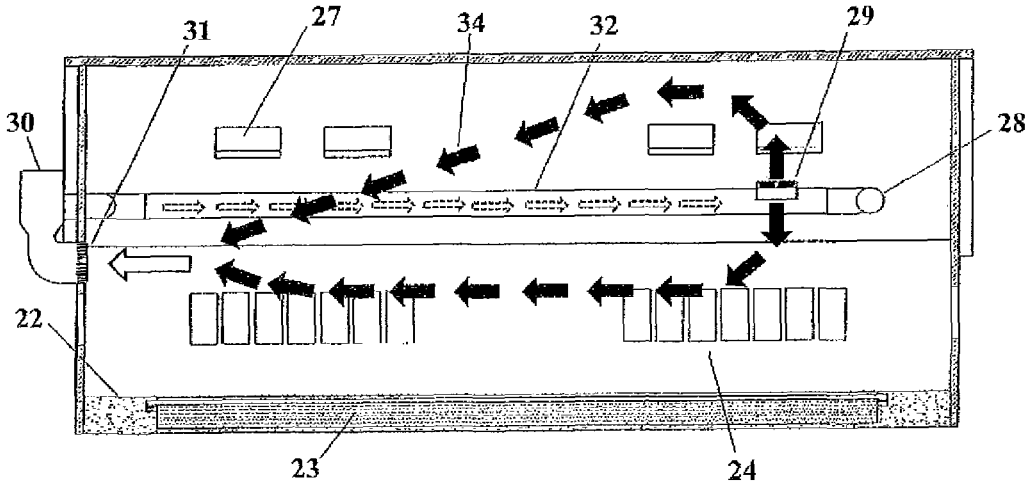
FIG. 7 is a cross-sectional view of FIG. 4 taken in the direction in which the arrows FIG. 7-7 point, showing typical air flow patterns produced by a natatorium HVAC system.

FIG. 4 schematically depicts a typical natatorium showing three cross-sectional view callouts. FIG. 5-5 is a vertical section and refers to a view in the direction of the arrows labeled FIG. 5-5. FIG. 6-6 is a horizontal section and refers to a view in the direction of the arrows labeled FIG. 6-6. FIG. 7-7 is a vertical section and refers to a view in the direction of the arrows labeled FIG. 7-7. These views will be referenced in detail herein below. FIGS. 5, 6 and 7 show the complex airflow patterns required from the HVAC system 28 in a conventional natatorium.

Shown in FIG. 5 is a typical natatorium airflow pattern viewed in the plane of the vertical section identified as FIG. 5-5 in FIG. 4. An air supply 32 from the natatorium HVAC system 28 supplies fresh, dry air for a skylight wash 37 and a window wash 38 to flow over cold exterior surfaces, such as a typical skylight 27 and a typical window 24. These air washes are necessary to prevent damaging condensation from forming on un-insulated surfaces exposed to cold outside air. The window wash 38 air must also be directed to the seating area 25 to provide fresh air for spectators.

FIG. 6 shows a typical airflow pattern of a typical natatorium in the plane of the horizontal section shown as FIG. 6-6 in FIG. 4. The air supply 32 from an air handling unit 30 supplies fresh air through a multiplicity of air supply registers 29 to wash the windows 24, and also shows the HVAC air circulation pattern 34 as the air makes its way back to an air return 31 and the air handling unit 30. This HVAC air circulation pattern 34 is necessary to remove stale air and humidity from the natatorium atmosphere.

FIG. 7 shows a typical airflow pattern of a typical natatorium in the plane of the vertical section shown as FIG. 7-7 in FIG. 4. The air supply 32 from the air handling unit 30 is shown delivering fresh air through the air supply registers 29 to wash the windows 24 and skylights 27, and also shows the HVAC air circulation pattern 34 as the air makes its way back to the air return 31 and the air handling unit 30.

These air circulation patterns are complex and are split between several functions, some of which take place high in the spaces of the natatorium well away from the water surface where the DBP cloud 36 (as shown in FIG. 5 and FIG. 1) accumulates. The present disclosure provides a self-contained system that scavenges DBP-contaminated air from the area just above the water surface of an indoor swimming pool, and functions independently and without need of or influence from these HVAC air circulation patterns that exist indoors within the natatorium.

While at least one presently preferred embodiment of the invention has been described using specific terms, such description is for illustrative purposes only, and it is to be understood that changes and variations may be made without departing from the spirit or scope of the following claims. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A self-contained system for scavenging contaminated air from above the water surface of a swimming pool that is disposed indoors in controlled environmental air and that is defined in part by a first elongated pool edge along the length of one side of the pool and a second elongated pool edge displaced apart from and opposite the first pool edge, the system comprising:

a. a fresh air intake;

b. an air intake fan having a suction side and a pressure side, the suction side being connected to the fresh air intake;

c. a laminar flow diffuser configured to deliver a laminar flow of air and extending along the length of the first pool edge, the laminar flow diffuser defining a plurality of orifices configured to distribute equally on a volumetric basis along the length of the laminar flow diffuser, the air flowing through said orifices;

d. a pressure plenum disposed in flow communication between the pressure side of the air intake fan and the orifices of the laminar flow diffuser;

e. a collection plenum extending along the length of the second pool edge and disposed in flow communication with the orifices of the laminar flow diffuser;

f. an air exhaust fan having a suction side and a pressure side;

g. an exhaust duct having one end and an opposite end, the one end connected to the collection plenum and the opposite end connected to the suction side of the air exhaust fan; and h. an external discharge duct having one end and an opposite end, the one end of the external discharge duct connected to the pressure side of the exhaust fan.

2. The system of claim 1, further comprising a fresh air supply duct having one end connected to the pressure side of the air intake fan and an opposite end connected to the pressure plenum, wherein the area of the orifices in the laminar flow diffuser varies as a function of the distance of the orifices from the opposite end of the fresh air supply duct connected to the pressure plenum when that distance is measured at any point along the pressure plenum parallel to the first elongated pool edge.

3. The system of claim 1, further comprising a fresh air supply duct having one end connected to the pressure side of the air intake fan and an opposite end connected to the pressure plenum, wherein the open area defined by the orifices of the laminar flow diffuser increases with the distance between the orifices and the opposite end of the fresh air supply duct connected to the pressure plenum.

4. The system of claim 1, further comprising a discharge port disposed outdoors and connected to the opposite end of the external discharge duct.

5. The system of claim 1, further comprising a contaminant stripper and a discharge port, the contaminant stripper connected to the opposite end of the external discharge duct, the discharge port connected in flow communication to the contaminant stripper.

6. The system of claim 1, wherein each orifice in the laminar flow diffuser is configured so that the air velocity through each orifice is consistent with a throat Reynolds Number less than approximately 1000 thereby giving laminar flow, so as to produce an air jet that resists mixing with the controlled environmental air.

7. The system of claim 1, further comprising a laminar flow collection diffuser extending along the length of the second pool edge and defining a plurality of orifices configured to distribute equally on a volumetric basis along the length of the laminar flow collection diffuser, the air flowing through said orifices.

8. The system of claim 1, further comprising a housing extending along the length of the first pool edge, wherein the laminar flow diffuser forms one wall of the housing and the fresh air intake forms another wall of the housing and is spaced apart from the laminar flow diffuser.

9. The system of claim 8, wherein the air intake fan is disposed within the housing and disposed between the laminar flow diffuser and the fresh air intake.

10. The system of claim 9, wherein the pressure side of the air intake fan is directed toward the laminar flow diffuser and the suction side of the air intake fan is directed toward the fresh air intake.

11. The system of claim 8, wherein the area of the orifices in the laminar flow diffuser varies as a function of the distance of the orifices from the air intake fan when that distance is measured at any point along and parallel to the first elongated pool edge.

12. The system of claim 8, further comprising a plurality of air intake fans disposed within the housing, each air intake fan being spaced apart along the length of the housing from each other air intake fan, each air intake fan being disposed between the laminar flow diffuser and the fresh air intake.

13. A method for scavenging contaminated air from above the water surface of a swimming pool that is disposed indoors in controlled environmental air and that is defined in part by a first elongated pool edge defining a pool deck above the water surface along the length of one side of the pool and a second elongated pool edge displaced apart from and opposite the first pool edge with a pool deck above the water surface, the method comprising:

a. supplying a controlled-velocity laminar flow scavenging air mass from one side of the indoor swimming pool;

b. directing the controlled-velocity laminar flow scavenging air mass across the water surface of the indoor swimming pool to push contaminated air from above the water surface of the swimming pool toward the opposite second pool edge of the indoor swimming pool;

c. collecting in a collection plenum disposed along the second pool edge of the indoor swimming pool the contaminated air pushed by the controlled-velocity laminar flow scavenging air mass across the water surface of the indoor swimming pool toward the opposite second pool edge of the indoor swimming pool; and d. using an air exhaust fan having its suction side connected to the collection plenum to suck the contaminated air from the collection plenum into an external discharge duct having one end connected to the pressure side of the air exhaust fan.

14. The method of claim 13, wherein the controlled-velocity laminar flow scavenging air mass supplied from one side of the indoor swimming pool emanates from a laminar flow diffuser having a plurality of orifices configured so that the air velocity through each orifice is consistent with a throat Reynolds Number less than approximately 1000 thereby giving laminar flow, so as to produce an air jet that does not mix with the environmental air.

15. The method of claim 14, wherein the controlled-velocity laminar flow scavenging air is supplied from a fresh air supply duct, and the percentage of the laminar flow diffuser devoted to the open area of the orifices increases with the distance of the orifices from the fresh air supply duct.

16. The method of claim 14, wherein the controlled-velocity laminar flow scavenging air is supplied from a fresh air supply duct, and the area and spacing of the orifices in the laminar flow diffuser is varied as a function of the distance from the fresh air supply duct in order to create the desired uniform-velocity, laminar piston-like flow when measured at any point at any point along and parallel to the first elongated pool edge.

17. The method of claim 13, wherein the volumetric flow rate of the controlled-velocity laminar flow scavenging air mass supplied from one side of the indoor swimming pool is uniform along the length of the one side of the indoor swimming pool.

18. The method of claim 13, wherein the controlled-velocity laminar flow scavenging air mass supplied from one side of the indoor swimming pool takes the form of a piston-like laminar flow of air moving across the water surface of the swimming pool.

19. The method of claim 18, wherein the vertical depth of the piston-like laminar flow of scavenging air mass is substantially confined between the pool decks and the water surface.

20. The method of claim 13, further comprising discharging the contaminated air from the external discharge duct to the outdoors.

21. The method of claim 13, further comprising discharging the contaminated air from the external discharge duct to a contaminant stripper that strips the contaminants from the air and recycles the stripped air indoors.

* * * * *